United States Patent [19]

Craig

[11] 4,066,807

[45] Jan. 3, 1978

[54] MARKING METAL

[75] Inventor: Alexander Robertson Craig, Glasgow, Scotland

[73] Assignee: Hilti Aktiengesellschaft, Schaan, Furstentum, Liechtenstein

[21] Appl. No.: 658,169

[22] Filed: Feb. 17, 1976

[30] Foreign Application Priority Data

Feb. 19, 1975 United Kingdom ..... 6953/75

[51] Int. Cl.[2] ..... B05D 1/32

[52] U.S. Cl. ..... 427/282; 101/114; 101/129; 118/301; 134/6; 134/22 R; 134/24; 134/37; 427/287; 427/427

[58] Field of Search ..... 134/6, 37, 22 R, 24; 118/301, 302; 427/282, 287, 422, 427, 445; 15/405; 355/15; 101/112, 114, 121, 122, 129

[56] References Cited

U.S. PATENT DOCUMENTS

| | | | |
|---|---|---|---|
| 537,923 | 4/1895 | Hildyard | 118/301 UX |
| 2,241,051 | 5/1941 | Berger | 118/301 X |
| 3,088,859 | 5/1963 | Smith | 427/282 X |
| 3,143,960 | 8/1964 | Naczynski | 118/301 X |
| 3,251,341 | 5/1966 | Eburn et al. | 118/302 |
| 3,399,649 | 9/1968 | Kidgell et al. | 118/301 X |
| 3,498,260 | 3/1970 | De Jean et al. | 118/301 X |
| 3,741,157 | 6/1973 | Krause | 355/15 X |

*Primary Examiner*—S. Leon Bashore
*Assistant Examiner*—Marc L. Caroff
*Attorney, Agent, or Firm*—Toren, McGeady and Stanger

[57] ABSTRACT

In the marking of metal, for example, steel billets, by spraying aluminum through a stencil, the sprayed metal tends to build up on the stencil and render it inoperative. To reduce the metal build-up, a release compound is applied to the stencil surface and the surface is cleaned periodically during use. The release compound can be sprayed-on and cleaning can be effected by a rotary brush, both movable with the metal spray nozzle.

12 Claims, 3 Drawing Figures

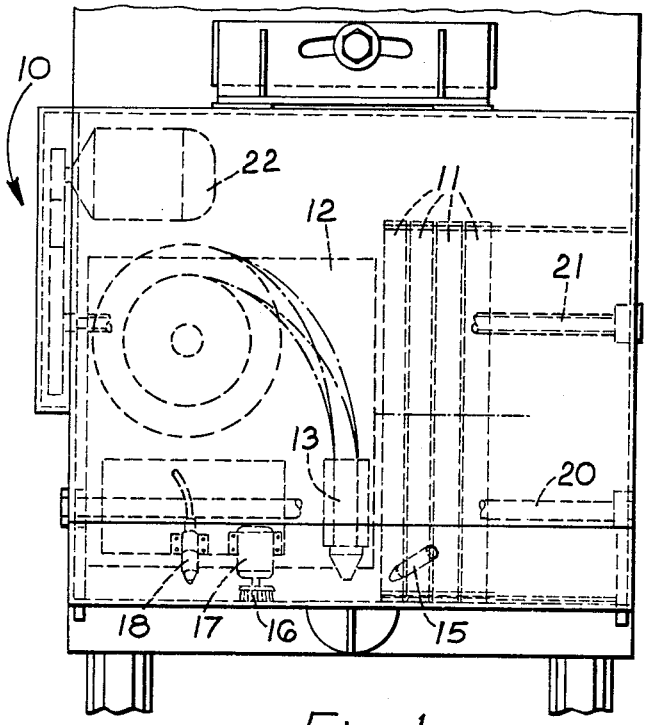
Fig. 1.
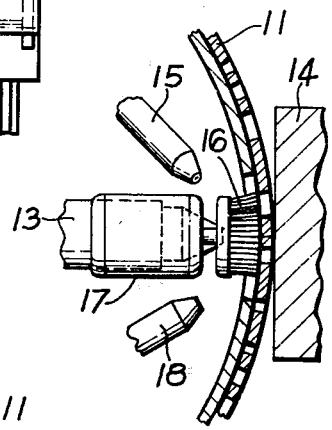
Fig. 3.
Fig. 2.
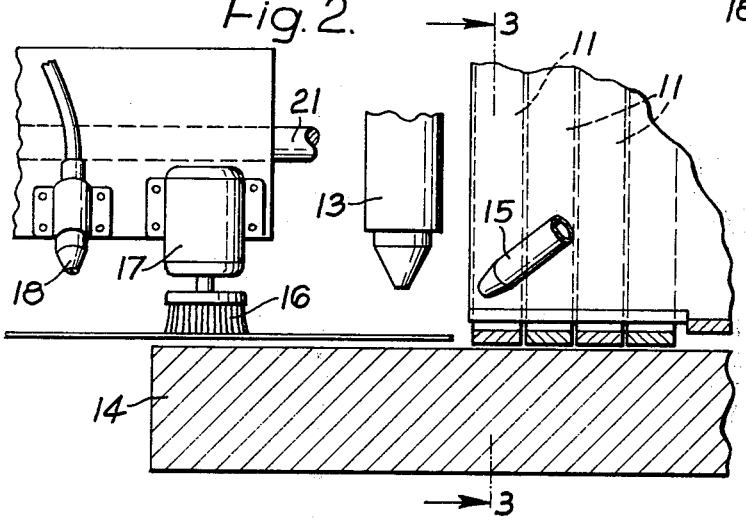

MARKING METAL

SUMMARY OF THE INVENTION

This invention relates to the marking of metal surfaces, such as steel plates, slabs and billets in a steel rolling mill.

A method of and apparatus for effecting such marking is known wherein molten metal, such as aluminum, is sprayed through stencils onto the metal surface. Markings thus formed are particularly legible and resistant to erasures.

One problem with this method, however, is that the molten metal tends to build up on the stencils after prolonged use and can render the apparatus inoperable. An object of the present invention is to provide an improved method of and apparatus for marking metal, wherein the above problem is obviated or minimized.

Accordingly the invention provides a method of marking metal including spraying molten metal through a stencil onto the metal surface to be marked, wherein a release compound is applied to the stencil surface periodically during use. Preferably the stencil is cleaned, also periodically, for example, by brushing. The release compound helps to prevent the molten metal from sticking to the surface of the stencil to the extent it can be removed by brushing.

The nature of the release compound is not at all critical; all that is required is that it forms a film on the surface of the stencil. Preferably a suspension or solution is sprayed onto the stencil to leave a film of the compound on the stencil after the liquid has evaporated or drained away. Liquids which have been used range from engineers' marking fluid, to felt-tipped marker fluid to Milk of Magnesia. Shoe polish applied directly, has also proved successful.

Preferably the compound is applied before each molten metal spraying step and the stencil is cleaned after each such spraying step.

The invention is also directed to apparatus for marking metal, including means for spraying molten metal through a stencil, and means for periodically applying a release compound to the stencil during use of the metal spraying means.

Preferably the apparatus also includes means for periodically cleaning the stencil, such as a brush and/or an air jet.

When the apparatus includes a reciprocating carriage mounting a molten metal spray gun, the means for applying the release compound can comprise a spray nozzle on the carriage and connected to a supply of compound. The cleaing brush can also be mounted on the carriage and a rotary brush can be used.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there is illustrated and described a preferred embodiment of the invention.

BRIEF DESCRIPTION OF THE DRAWING

FIG. 1 is a plan view of a preferred embodiment of the apparatus of the invention;

FIG. 2 is a horizontal cross-section, on an enlarged scale, through the operative parts of the apparatus of FIG. 1; and FIG. 3 is a cross-section on the line 3—3 in FIG. 2, a brush of the apparatus being in a cleaning position.

DETAILED DESCRIPTION OF THE INVENTION

In FIGS. 1, 2 and 3 an apparatus 10 for marking metal is shown. The apparatus includes stencil rings 11 indexable past an operating or working position and a carriage 12 reciprocable past that position with the carriage movable transversely of the direction of movement on the stencil rings. The carriage 12 is mounted on two rails 20, 21. Rail 20 is a smooth sliding rail, but rail 21 is threaded and a nut, not shown, on the carriage engages this rail. Rotation of rail 21 by a motor 22 causes movement of the carriage 12 in the direction of the rails. The carriage 12 supports a spray gun 13 for molten aluminum which operates, during only an outward stroke of the carriage 12, that is, in the rightward direction in FIG. 2, to spray aluminum through the stencil rings 11 to form a marking on the surface of metal members 14 located on the other side of the stencil rings from the spray gun.

Also mounted on the carriage 12 are a spray nozzle 15 for spraying a liquid release compound capable of leaving a release coating on the stencil rings 11 and a brush 16 for brushing the stencil rings 11 to clean them. The spray nozzle 15 is connected to a supply (not shown) of the liquid and the brush 16 is a rotary wire brush connected to an electric, pneumatic or hydraulic motor 17. The spray nozzle 15 is on the outward or right side of the gun 13 and the brush 16 is on the inward or left side of the gun 13 as viewed in FIG. 2. An air blast nozzle 18 is disposed near the brush 16 to blow away marking metal removed by the brush 16 from the stencil surface.

The apparatus operates according to a preferred method of the invention. During the operative movement of the carriage 12 (i.e., to the right in FIG. 2) the spray gun 13 sprays liquid metal through the stencils onto the surface of the metal members 14 to be marked and the brush 16, following behind, cleans off the sprayed metal from the inner faces of the stencil rings, removal thereof being facilitated by an air blast from nozzle 18. During the return stroke of the carriage 12 (i.e., to the left in FIG. 2) with the metal spray gun 13 inoperative, the liquid spray nozzle 15 operates to spray liquid onto the cleaned surfaces of the stencil rings to form a coating of a release compound thereon. The liquid used in tests has been an engineers' marking fluid (manufactured by Spectra Chemicals Limited). This fluid consists of china clay and titanium dioxide in a volatile solvent. However, the solvent is inflammable and this fluid would probably not be suitable for use in a steelworks because the solvent would present a fire hazard. However, a suspension of similar materials in a non-flammable non-toxic fluid would be suitable.

The process is repeated, the stencil rings 11 being coated before and brushed after each metal spraying.

The invention is not limited to the precise details of the foregoing and variations can be made thereto. For example application of the coating, and brushing, can be effected only once every five or ten sprayings if desired. The cleaning need not be effected by means of a brush, a scraper or other suitable cleaning means could be used. A strong jet of air or other fluid might be sufficient. Many other variations are possible.

While a specific embodiment of the invention has been shown and described in detail to illustrate the application of the inventive principles, it will be understood that the invention may be embodied otherwise without departing from such principles.

What is claimed is:

1. A method of marking metal surfaces comprising moving a stencil member into a marking position, moving individual metal surfaces into the marking position, spraying a liquid metal from a liquid metal spray member through the stencil onto the metal surface in the marking position, and during the marking operation periodically applying a release compound from a release compound member to the surface of the stencil through which the liquid metal is sprayed and depositing a release coating on the stencil for aiding in the removal of the sprayed metal which remains on the stencil surface, periodically cleaning the surface of the stencil through which the liquid metal is sprayed and on which the release coating has been applied for removing the sprayed metal from the stencil surface, performing the step of applying the release compound for depositing the release coating before each step of spraying of the liquid metal for marking a metal surface and performing the step of cleaning the stencil surface after each spraying of the liquid metal, brushing the stencil surface with a brush member for carrying out the cleaning step, supporting the liquid metal spray member, the release compound member and the brush member on a support member, and moving the support member relative to the stencil surface through the stencil member and transversely of the direction of movement of the stencil member.

2. A method, as set forth in claim 1, wherein the release compound includes a release agent in the form of a suspension of solids in a non-flammable, non-toxic liquid and the step of applying the release compound comprises spraying the compound onto the stencil surface.

3. A method, as set forth in claim 1, wherein the brushing step is effected by a rotary brushing action.

4. A method, as set forth in claim 1, including the step of directing a flow of air onto the stencil surface during the brushing action for removing the metal dislodged by the brushing action.

5. A method of marking metal surfaces comprising positioning a metal surface at a marking position, moving stencils for indexing the stencils over the metal surface at the marking position to locate the desired marking indicia in the marking position, supporting a liquid metal spray member on a support member and moving the support member with the liquid metal spray member through the stencils transversely of the direction of movement in indexing the stencils over the metal surface at the marking position over the stencil surface in the marking position and spraying liquid metal from the spray member through the stencil onto the metal surface, mounting a release compound spray member and a cleaning member on the support member for the liquid metal spray member for moving the release compound spray member and cleaning member with the liquid metal spray member transversely of the direction of movement in indexing the stencil, and applying a release coating of a release compound from the release compound spray member on the stencil surface before the liquid metal spray step and cleaning the stencil surface with the cleaning member after the liquid metal spray step for removing from the stencil surface any metal deposited thereon by moving the support across the stencil surface.

6. Apparatus for marking metal surfaces, comprising stencil means, means for moving said stencil means over the metal surface to be marked, means for spraying a liquid metal through the stencil means for marking the metal surface, means for applying a release compound onto the surface of the stencil means through which the liquid metal is sprayed for depositing a release coating for aiding in the removal of the sprayed liquid metal deposited on the surface of the stencil means, cleaning means for removing sprayed metal from the surface of said stencil means, support means, means for moving the support means through said stencil means and transversely of the direction of movement of said stencil means, said support means supporting said liquid metal spray means, said release compound applying means and said cleaning means so that the release compound is applied to the stencil means before liquid metal is sprayed through the stencil means and sprayed metal is removed from the stencil means after liquid metal is sprayed through the stencil means.

7. Apparatus, as set forth in claim 6, wherein said cleaning means comprises a brush.

8. Apparatus, as set forth in claim 6, wherein said cleaning means comprises a nozzle for directing a jet of air against the surface of said stencil means.

9. Apparatus, as set forth in claim 7, wherein said cleaning means comprises a nozzle for supplying a jet of air to the surface of the stencil means for removing metal dislodged by said brush.

10. Apparatus, as set forth in claim 6, wherein said means for applying the release compound comprises a spray nozzle.

11. Apparatus for marking metal comprising a plurality of stencil rings, means for movably indexing the stencil rings to a marking position, a carriage, means for reciprocally moving the carriage past the marking position through the stencil rings and in a direction transverse to the direction of movably indexing the stencil rings, a spray gun for liquid metal mounted on the carriage for spraying liquid metal through said stencil rings in the marking position onto the metal to be marked, means mounted on said carriage for applying a release compound to the surface of the stencil rings through which the liquid metal is applied for depositing a release coating thereon at the marking position prior to the spraying of the liquid metal, and means mounted on such carriage for removing sprayed metal adhered to the surface of the stencil means after the liquid metal spraying, said means for applying the release compound comprises a spray nozzle and said means for removing sprayed metal comprises a brush, so that the application of the release compound, the spraying of the liquid metal and the brushing of the stencil surface can be effected in the reciprocal movement of said carriage.

12. Apparatus, as set forth in claim 11, wherein said brush is a rotary brush and said means for removing sprayed metal includes an air nozzle for supplying a jet of air for removing metal dislodged by said brush.

* * * * *